US005551108A

United States Patent [19]

Butler, III

[11] Patent Number: 5,551,108

[45] Date of Patent: Sep. 3, 1996

[54] PORTABLE BABY CUSHION AND COVER COMBINATION

[76] Inventor: George D. Butler, III, 1960 Hughes Dr., Cumming, Ga. 30130

[21] Appl. No.: 175,602

[22] Filed: Dec. 30, 1993

Related U.S. Application Data

[63] Continuation-in-part of Ser. No. 1,692, Nov. 20, 1992, Pat. No. Des. 342,855.

[51] Int. Cl.[6] ..... A47D 13/00; A47C 27/14; A47G 9/04

[52] U.S. Cl. ..... 5/655; 5/494; 190/1; 383/4

[58] Field of Search ..... 5/655, 494, 490, 5/482, 922, 923; 383/4; 190/1, 2; D6/596, 601

[56] References Cited

U.S. PATENT DOCUMENTS

| | | | |
|---|---|---|---|
| D. 259,458 | 6/1981 | Fuller et al. | 5/655 |
| D. 309,068 | 7/1990 | Jordan et al. | D6/601 |
| D. 328,683 | 8/1992 | Kalozdi | D6/601 |
| 1,602,941 | 10/1926 | Rosman . | |
| 1,863,256 | 6/1932 | Snoddy | 5/494 |
| 2,405,484 | 8/1946 | Bailhe | 9/17 |
| 2,567,082 | 9/1951 | Shuster | 5/494 |
| 3,060,462 | 10/1962 | Miller | 5/334 |
| 3,083,378 | 4/1963 | Pursell | 5/494 |
| 3,363,272 | 1/1968 | Channon | 9/348 |
| 3,636,566 | 1/1972 | Sutherland | 2/69.5 |
| 4,161,044 | 7/1979 | Bogle | 5/494 |
| 4,316,287 | 2/1982 | Rule | 5/413 |
| 4,607,403 | 8/1986 | Alivizatos | 5/449 |
| 4,790,041 | 12/1988 | Shtull | 5/424 |
| 4,790,042 | 12/1988 | Reich | 5/437 |
| 4,825,487 | 5/1989 | Eberl | 5/464 |
| 5,014,376 | 5/1991 | Doran et al. | 5/494 |
| 5,103,514 | 4/1992 | Leach | 5/417 |
| 5,333,769 | 8/1994 | Skorski | 5/655 |

*Primary Examiner*—Alexander Grosz
*Attorney, Agent, or Firm*—Bernstein & Associates

[57] ABSTRACT

An infant cushion and cover combination including an integrated blanket and a cushion placed inside of a fabric cover. The fabric cover includes a blanket which is closable over the top of the fabric cover. With the blanket closed, an infant may be positioned between the top of the fabric cover and the blanket. The cushion has elevated edges that prevent an infant from rolling off the cushion. The cushion may be removed from the fabric cover and is then usable as a diaper changing pad with the moisture resistant cover in place over the cushion.

11 Claims, 4 Drawing Sheets

PORTABLE BABY CUSHION AND COVER COMBINATION

This application is a continuation-in-part application of Design application 29/001,692, filed on Nov. 20, 1992 now U.S. Design patent No. Des. 342,855.

FIELD OF THE INVENTION

The present invention relates to sleeping pads for infants, and more particularly to a foldable cushion enclosed in a fabric cover having an integrated blanket.

BACKGROUND OF THE ART

Infants must be protected from their environment. This protection relates both to the physical environment, i.e., restricting the movement of an infant so as to prevent injury from falls and/or provide a natural, papoose-like sleeping area, and the climatological environment, i.e., ensuring that an infant is protected from changing temperatures. The comfort of the sleeping environment of an infant is extremely important. An infant who is too cold or who is placed on an uncomfortable surface is very likely to have a restless sleep, inadequate duration of sleeping periods, and, in the best case, will be cranky and, in the worst case, unhealthy.

Traveling with infants is often difficult because the amount of accompanying paraphernalia gear required. Parents typically must carry on any trip items such as baby seats, diapers, baby formula, toys, extra clothes, blankets, and bedding. The portability of any one such item is therefore of primordial importance to a parent. Multiple uses of required items also reduces the burden of carrying more baby gear and also provides the infant with a familiar sleeping environment even away from home.

DISCUSSION OF THE PRIOR ART

Leach (U.S. Pat. No. 5,103,514) teaches a design of a utility pad for an infant which includes a rectangular fabric tube filled with a resilient, flexible material and extending peripherally around an interior space. An infant may be placed in the interior space. Leach's cushion may be folded in a manner which facilitates carrying the pad from one location to another. Leach does not address the problem of carrying additional items.

Doran et al. (U.S. Pat. No. 5,014,376) teaches a design of an apparatus for supporting an infant. Doran's apparatus includes a wedge shaped support member and a blanket which may be attached to the support member. Doran does not teach multiple uses of the apparatus.

These infant cushions suffer from the deficiencies that they are limited to one use, namely, providing a sleeping environment. There are no prior art designs for integrated cushions and blankets which provide for multiple uses such as providing a sleeping environment for the infant, a carrying case for gear, a diaper changing pad, etc.

SUMMARY OF THE INVENTION

Generally described, the present invention provides an integrated cushion and blanket for an infant. Additionally, the cushion and fabric cover of the present invention when folded may be used as a carrying case for carrying items such as diapers, clothes, toys and baby food.

The cover of the present invention includes a fabric cover with an integrated blanket. The cushion is placed inside the fabric cover. The blanket is attached to the open end of the cover and is closable over the top of the cover, and can be secured to the sides of the cover using one or more fasteners, e.g., constructed from VELCRO® or the means.

The cushion is made of a resilient, foldable material. When the cushion is folded the cushion and cover combination is usable as a carrying case. In the carrying case mode the blanket is closable over the folded cushion and thereby secures it in its folded position providing a suitable enclosure for transporting all of the necessary accessories needed for infants while away from the home.

The cushion, which may be covered by a moisture resistant cover, may be removed from the fabric cover and blanket. When removed the cushion may be used as a portable diaper changing pad. The cushion has elevated edges which prevent an infant from rolling off the cushion.

It is therefore a principal object of the invention to provide an integrated cushion and cover with integrated blanket for providing a secure and comfortable sleeping environment for an infant.

It is a further object of the invention to provide a cushion and cover combination in which the cushion is located in a fabric cover with integrated blanket, and the blanket forms a flap which may be securely closed over the cushion and attached to the sides of the fabric cover.

It is an additional object of the invention to provide a cushion and cover combination in which the blanket may be closed over an infant's torso and secured to the sides of the fabric cover.

It is a further object of the invention to provide a cushion and cover combination which may used as a carrying case.

It is an additional object of the invention to provide a cushion with a moisture resistant cover for a cushion and cover combination which may be optionally removed from the fabric cover and then used as a diaper changing pad.

Other objects, features, and advantages of the present invention will become apparent upon reading the following detailed description of embodiments of the invention, when taken in conjunction with the accompanying drawing and the appended claims.

BRIEF DESCRIPTION OF THE DRAWINGS

The invention is illustrated in the drawings in which like reference characters designate the same or similar parts throughout the Figures of which.

DESCRIPTION OF THE PREFERRED EMBODIMENTS

Figure 2:
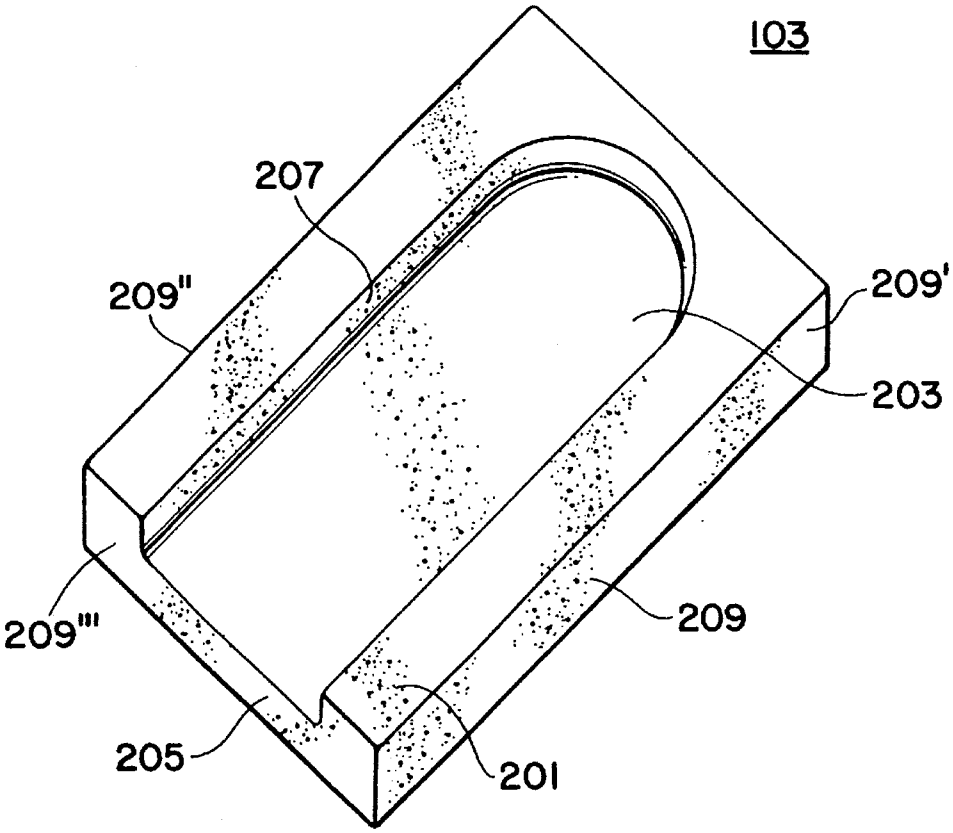
FIG. 2 is a perspective view of a molded cushion which provides an inner core of the baby cushion and cover combination of FIG. 1.

FIGS. 1–7 show various views of a baby cushion and cover combination 100 according to the present invention. The baby cushion and cover combination 100 consists of an outer fabric covering or blanket 101 and a molded cushion 103 that is placed in a fabric envelope 105 of the blanket 101. The fabric envelope 105 is of such shape and size that the cushion 103 fits tightly inside the fabric envelope 105, but such that the cushion 103 may easily be removed from the envelope 105. Removability of the cushion 103 allows the fabric cover 101 to be separately washed, e.g., in a washing machine.

Figure 4:
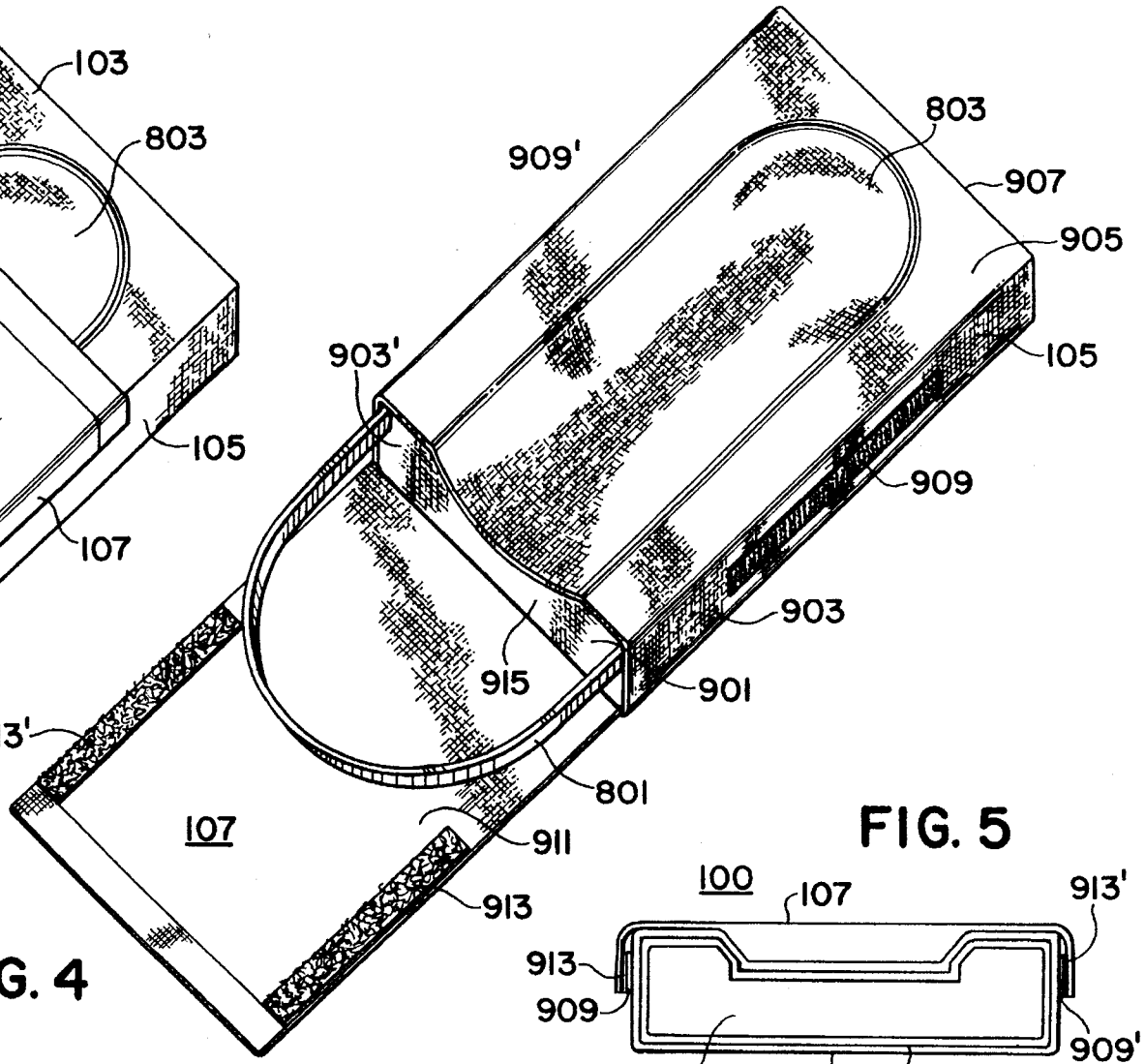
FIG. 4 is a perspective view of the cushion and cover combination showing the blanket in an open position and showing fasteners for securing the blanket to the sides of the fabric cover.
Figure 5:
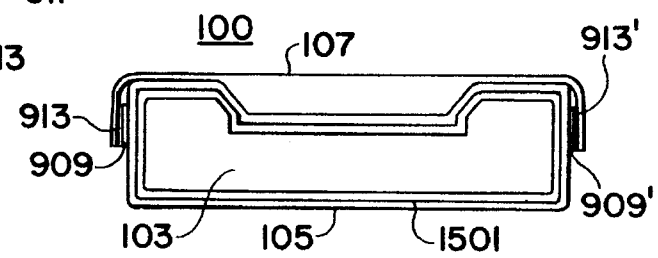
FIG. 5 is a cross-sectional view of the cushion and cover combination.

The fabric cover 101 is preferably made from 100% cotton flannel or any other fabric, such as a natural or synthetic material or a blend thereof. Alternatively, a disposable nonwoven material can be used. The fabric cover 101 further consists of a blanket 107 as shown in FIG. 4. The blanket 107 is attached to the fabric envelope 105 at the open end of the fabric envelope 105. An infant 109 may be placed on top of the cushion/fabric envelope 103 and 105 and covered by the blanket 107.

Figure 1:
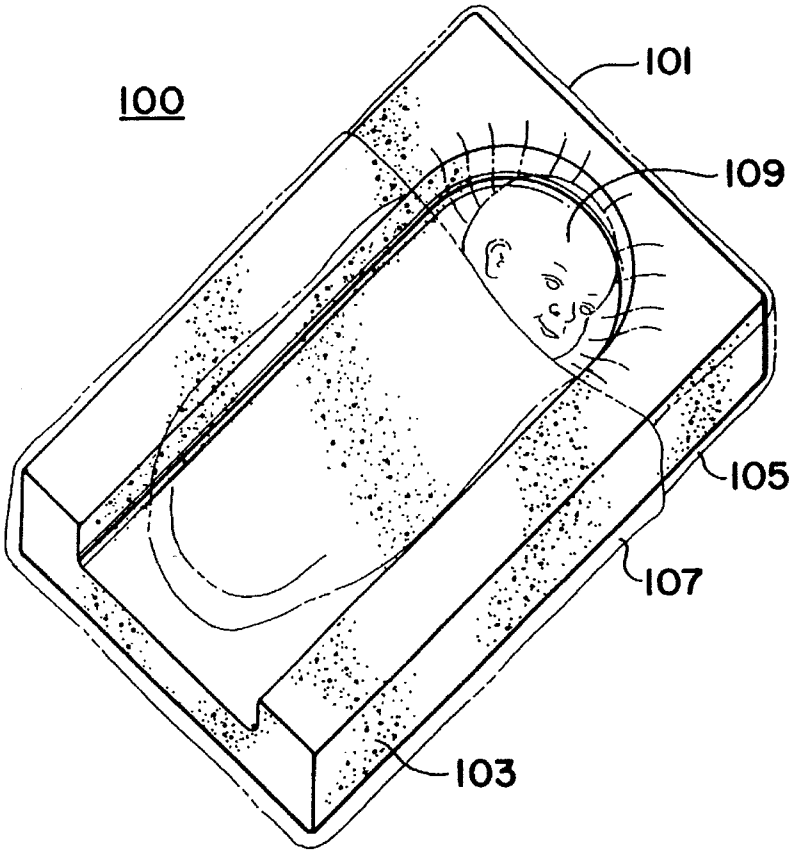
FIG. 1 is a perspective view of a baby cushion and cover combination according to the present invention.

FIG. 2 is a perspective view of the molded cushion 103 which provides an inner core of the baby cushion and cover combination 100 of FIG. 1. The molded cushion 103 has a raised outer edge 201. The raised outer edge 201 surrounds on three sides an inner area 203. An inner wall 207 defines a boundary between the inner area 203 and the raised outer edge 201. The raised outer edge 201 and the inner area 203 define generally parallel planes, and the inner wall 207 is generally perpendicular to the planes defined by the raised outer edge 201 and the inner area 203.

The molded cushion 103 further consists of four outer walls 209, 209', 209", and 209'''. Outer walls 209 and 209" are parallel with each other and perpendicular to the outer walls 209' and 209'''.

The rear edge 205 of the molded cushion 103 is of the same thickness as the inner area 203.

In a preferred embodiment the elevated edges 201 are approximately 3½ inches wide and the sides 209, 209' and 209" are approximately 4 inches thick. In the same preferred embodiment the inner area 203 is approximately 9 inches wide and 2 inches thick. The elevated edges of the inner wall 207 are approximately 2 inches. The total length of the cushion 103 is approximately 29 inches and its total width is approximately 16 inches. At its longest the inner area is approximately 27 inches long. The head end of the inner area 203 forms a semicircle with a radius of approximately 4½ inches. It is to be understood that various dimensions can be used according to the desire of the manufacturer for different size infants. Additionally, the walls 207 may converge if desired.

Having the above described dimensions, an advantage of the present invention is that the cushion and cover combination 100 may be placed inside a standard sized bassinet, thereby providing an integrated bumper pad and cushion and also placed sideways in a standard crib providing a more comforting and cozy environment compared to the crib alone.

The molded cushion 103 is fabricated from a soft, yet resilient, material such as foam that provides a comfortable resting surface for an infant. The molded cushion may be folded, but retains its original shape when released from a folded position. Alternatively, the material can be air, fluid, gel or a mixture thereof maintained within at least one chamber or a matrix of chambers. Alternatively, the material can be shredded cloth, Styrofoam or similar material, placed within a sealable pouch.

Figure 3:
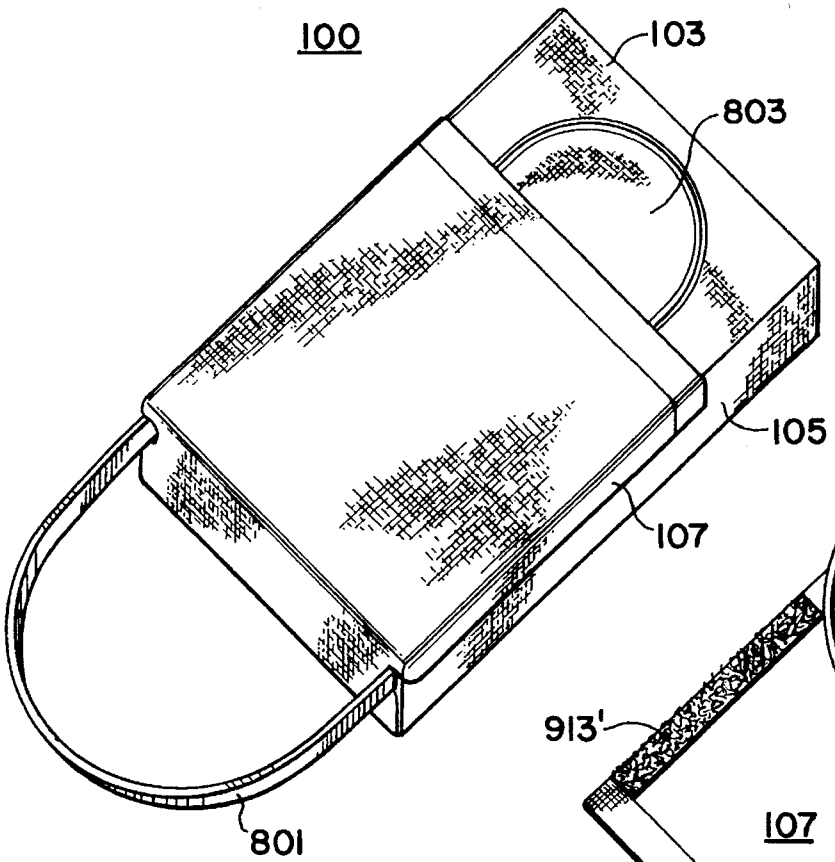
FIG. 3 is a perspective view of the cushion and cover combination of FIG. 1 showing the blanket in a closed position and attached to sides of fabric cover.

FIG. 3 is a perspective view of the cushion and cover combination of FIG. 1 showing the blanket 107 of the fabric blanket 101 in a closed position. A handle 801 is attached at each side of the sack 105 at its open end near where the blanket 107 is attached to the fabric cover 105.

The blanket 107 is of such size and shape that when folded over the fabric cover 105 it substantially covers the inner area 203 except for an area 803. The covered area is of such size and shape as to cover the body of an infant placed on top of the cushion/fabric envelope 103 and 105.

FIG. 4 is a perspective view of the cushion and cover combination of FIG. 3 showing the blanket 107 of the fabric cover in an open position and showing fasteners 909 as described in detail hereinbelow for removably securing the blanket 107 to the sides of the fabric cover 105.

The fabric cover 105 is formed from a bottom panel 901, two side panels 903 and 903', a top panel 905 and a forward panel 907. The panels 901, 903, 903', 905, and 907, may be either made from individual pieces of material or from one sheet of material. In either embodiment, the panels 901, 903, 903', 905 and 907 are sewn together to form fabric cover 105.

The blanket 107 is formed from a rectangularly shaped piece of fabric or may be cut from the same sheet of fabric as the bottom panel 901. In either embodiment, one edge of the rectangular flap 107 is attached to one edge of the bottom panel 901 at the open end of the sack 105. The flap 107 has an inside surface 911 and an outside surface (the outside surface is not visible in FIG. 4). The flap 107 may be from several layered sheets of fabric, thereby providing a warm environment for an infant resting between the top of the sack 105 and the flap 107.

Two fasteners 909 and 909' are attached to the side panels 903 and 903', respectively. Similarly, two fasteners 913 and 913' are attached to the inside surface 911. The fasteners 913 and 913' are positioned on the inside surface 911 so as to mate with the fasteners 909 and 909', respectively, when the blanket 107 is placed in the closed position (as shown in FIG. 3).

The fasteners 909, 909', 913, and 913' may for example be strips of VELCRO®, in which embodiment the fasteners 909 and 909' may be of the hook type and the fasteners 913 and 913' may be of the loop type, or vice versa. Other fastening means are usable, such as, but not limited to clips, buttons, snaps, zippers, catches and the like.

The molded cushion 103 may be removed from the fabric cover 105 through an opening 915 when the blanket 107 is positioned in its open position, as shown in FIG. 4.

The cushion 103 is preferably covered with a moisture resistant cover 1000 made, for example, of CHEMSOFT™ material, although any suitable material may be used. By removing the cushion 103 from the fabric cover 101, the cushion 103 may be used as a portable changing pad whereby the cover 1000 prevents moisture from contaminating the cushion 103. The elevated edges 201 provide security against the infant rolling off the changing table (not shown). The moisture resistant cover 1000 is easily wiped clean.

Figure 6:
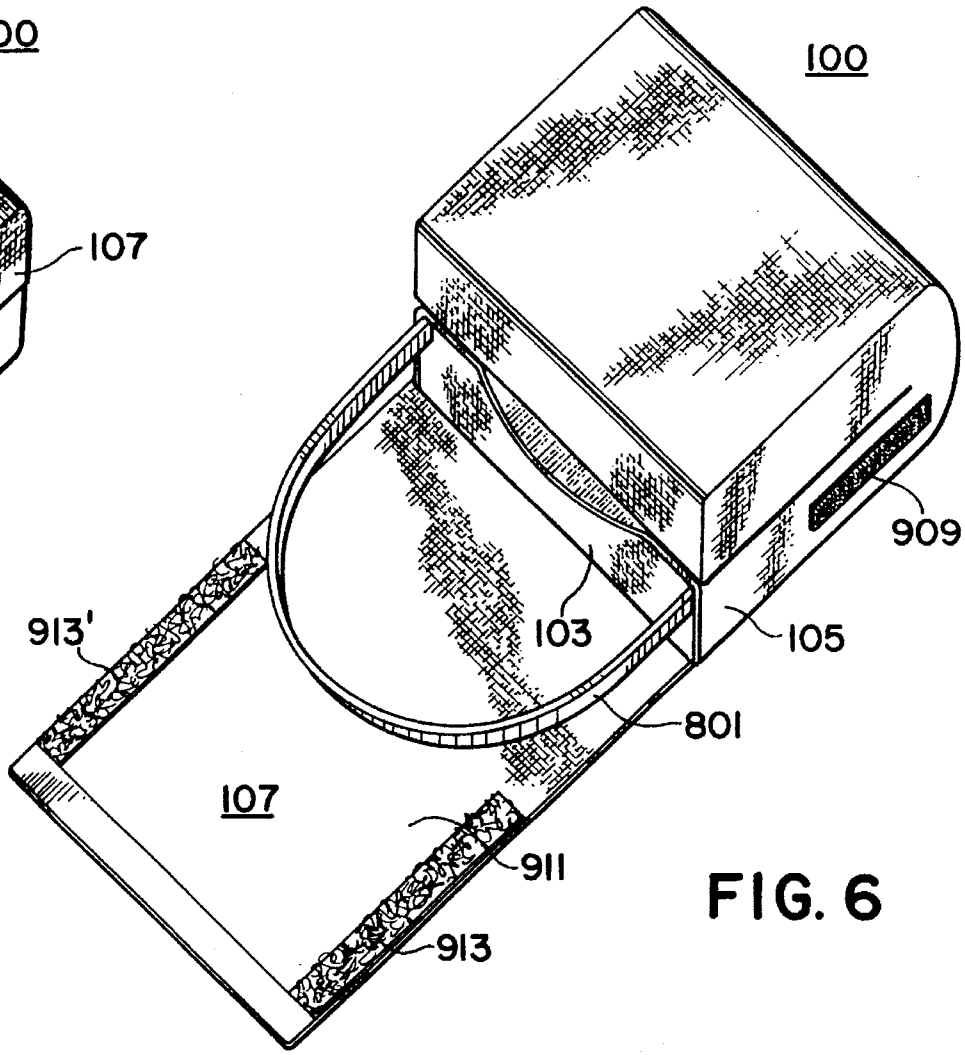
FIG. 6 is a perspective view of the cushion and cover combination according to the present invention in a folded position with its flap in the open position.

FIG. 6 is a perspective view of the cushion and cover combination 100 in a folded position with the blanket 107 in its open position. In the folded position the cushion fabric cover combination 100 contains a cavity formed by the elevated ridge 201 and the inner area 203 and serves as a storage area or shoulder bag, for example, to carry diapers, infant clothing, toys, infant food, or other supplies. In the folded position the cushion and fabric cover combination 100 can be conveniently carried by placing the handle 801 over the shoulder.

Figure 7:
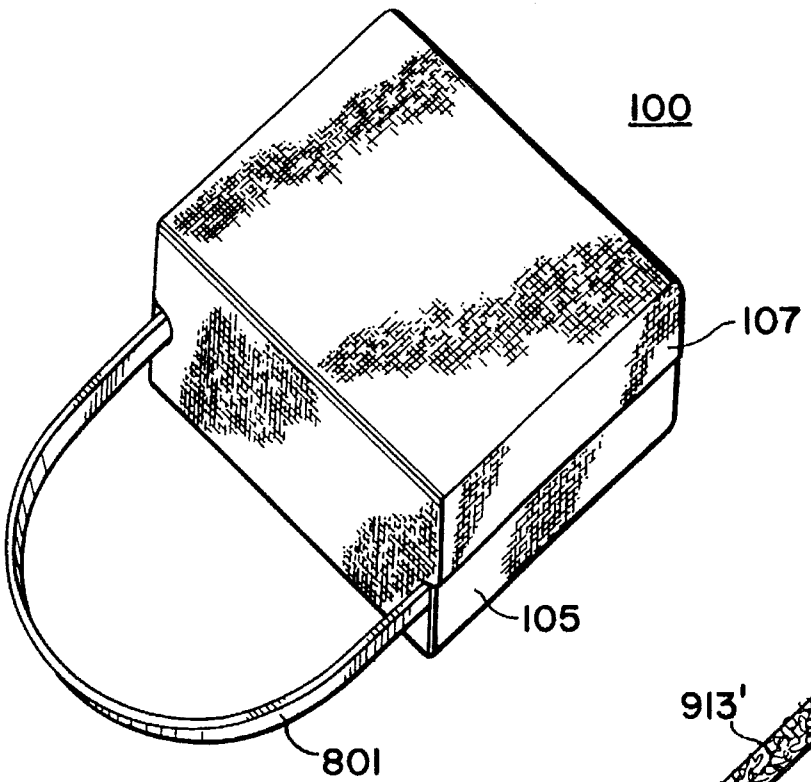
FIG. 7 is perspective view of the cushion and cover combination in the folded position with the blanket in its closed position.

FIG. 7 is a perspective view of the cushion and cover combination 100 in the folded position with the blanket 107 in its closed position. The blanket 107 secures the folded shape of the cushion 103. The blanket 107 is secured to the fabric cover 105 by fasteners 909, 909'.

Figure 8:
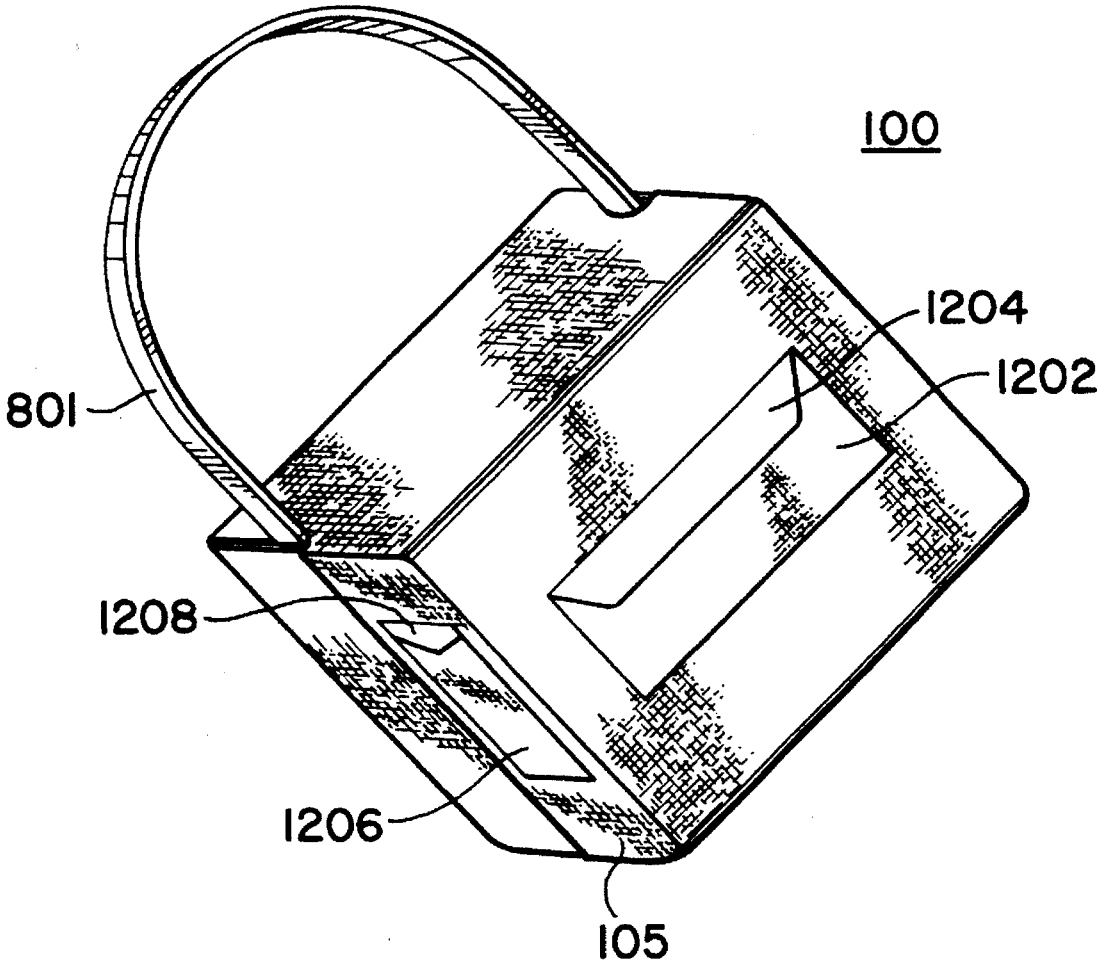
FIG. 8 is a perspective view of an alternative embodiment of the present invention showing a number of possible pockets attached to the sack.

In an alternative embodiment, shown in FIG. 8, the fabric cover 105 can have one or more pockets 1202 and 1206 disposed around the fabric cover for keeping various objects, such as a baby bottle, toys, wet wipes, and the like. The pockets can have flaps 1204 and 1208, respectively, secured by a fastening means, such as VELCRO. Other pockets can be positioned at different locations around the invention, and it is to be understood that different size, locations and numbers of pockets are anticipated by the present invention. Similarly, different fastening means, such as those described hereinabove can be employed. The pockets 1202 and 1206 can be sewn onto the sack 105.

The present invention provides the parents with a multifunctional product that can provide: a portable sleeping surface for overnight visits where accommodations are not available or suitable for infants; a portable sleeping surface that can be used throughout the home for those frequent nap times; an easily converted "tote bag" with built in changing pad; a support cushion when propped up at an angle to help strengthen the infants abdominal muscles and begin to prepare the infant for sitting upright, to be used when feeding, watching television, etc., all while being snuggled by the fabric cover and the supportive foam sides; and a travel pillow for the family when its folded in the storage "tote bag" configuration.

The present invention has been described in connection with certain preferred embodiments. Therefore, while the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. An infant cushion and cover combination comprising a generally elongated fabric cover having an open end and a longitudinally spaced closed end, a top portion adapted to support an infant, a cushion adapted to be removably positioned within said fabric cover through said open end, said cushion comprising a generally central infant supporting region with peripherally located, elevated edge portions, an elongated blanket portion integral with said cover and adjacent said open end, said blanket adapted to selectively cover and uncover said infant supporting top portion, and separable fastener means adapted to releasably secure said blanket to said cover, thereby covering an infant resting on the top portion of said cover.

2. The cushion and cover combination of claim 1, further comprising a handle attached to said fabric cover near said open end of said fabric cover.

3. The cushion and cover combination of claim 1, wherein said fasteners are made from VELCRO®.

4. The cushion and cover combination of claim 1, further comprising a moisture resistant cover substantially surrounding said cushion and located inside said fabric cover.

5. The cushion and cover combination of claim 1, wherein said cushion is constructed from a foldable material.

6. The cushion and cover combination of claim 1, wherein said cushion may be folded, and wherein in a folded position said cushion contains an interior cavity defined by said elevated edge portions.

7. The cushion and cover combination of claim 1, wherein said blanket is made from 100% cotton flannel.

8. The cushion and cover combination of claim 1, where said fabric cover is composed of a plurality of panels attached to one another.

9. The cushion and cover combination of claim 1, where said fabric cover is constructed from one sheet of fabric.

10. The integrated cushion and cover of claim 1, further comprising at least one pocket having a removably closable flap, said at least one pocket being attached to said fabric cover.

11. The cushion and cover combination of claim 1, wherein the separable fasteners comprise Velcro loop strips attached to edge areas of said fabric cover, and Velcro hook strips attached to edge areas of said blanket.

* * * * *